US005778084A

United States Patent [19]

Kling et al.

[11] Patent Number: 5,778,084

[45] Date of Patent: Jul. 7, 1998

[54] LOUDSPEAKER WITH PHASE CORRECTION

[76] Inventors: Martin Kling, Bernwardstrasse 25, D-30519 Hannover; Jurgen Freitag, Zun Brunnerhof 2, D-30659 Hannover, both of Germany

[21] Appl. No.: 788,276

[22] Filed: Jan. 24, 1997

[30] Foreign Application Priority Data

Jan. 27, 1996 [DE] Germany ..... 196 03 002.1

[51] Int. Cl.[6] ..... H04R 25/00

[52] U.S. Cl. ..... 381/156; 381/202; 381/158; 181/185; 181/159

[58] Field of Search ..... 381/156, 199, 381/158, 159, 202; 181/185, 177, 159

[56] References Cited

U.S. PATENT DOCUMENTS 4,157,741 6/1979 Goldwater ..... 381/156

*Primary Examiner*—Sinh Tran

*Attorney, Agent, or Firm*—Bierman, Muserlian and Lucas

[57] ABSTRACT

The invention concerns a loudspeaker with a diaphragm which is electromagnetically induced to vibrate and is made of a central dome-shaped part and a conical part surrounding the latter, and a phase-correction device, consisting of a cone fixed in the housing with its base side matching the shape of the diaphragm and of two rings surrounding the cone concentrically, between which there are sound paths from the diaphragm into the sound outlet area. The object of the invention is to smooth out the transmission characteristic of the loudspeaker named initially and to enlarge the transmissible frequency band with simple means. The invention is characterised in that the ring surrounding the cone covers the boundary area between the dome and the cone of the diaphragm and on the side facing the diaphragm consists of two essentially conical surfaces, in that the axes of the sound paths between the cone and the neighboring ring and between the two rings are each aligned on a point on the loudspeaker axis, in that the sound paths become broader as the distance from the diaphragm increases, and in that the distances from the middle of the underside of the cone and from the middle of the surface of the rings facing the diaphragm to the sound paths are roughly the same.

14 Claims, 2 Drawing Sheets

LOUDSPEAKER WITH PHASE CORRECTION

The present invention relates to loudspeakers, and particularly concerns a loudspeaker having a diaphragm which is electromagnetically induced to vibrate and is composed of a central dome-shaped part and an outer conical part surrounding the latter, and has a phase-correction device consisting of a cone fixed to the housing with its base side matching the shape of the diaphragm and of two rings surrounding the cone concentrically, between which there are sound paths from the diaphragm into the sound outlet area.

One such loudspeaker is known from U.S. Pat. No. 4,975,965. This serves for emission of high levels of sound energy and is therefore suitable for provision of sound systems for sports grounds and similar gathering places, but has the disadvantage of an unfavorable transmission characteristic, and the transmissible frequency band is also inadequate. For such gathering places as sports grounds loudspeakers with a good transmission characteristic and the broadest possible frequency band are not only required for music broadcasts, they are also needed in an emergency in order to be able to broadcast very clearly announcements on which human lives may depend.

Our own tests on this loudspeaker system have revealed that the shortcomings in the transmission properties are attributable to great differences in the length of the sound paths from the different emission points on the diaphragm to the sound outlet opening, and unfavorable alignment of these paths causing attenuation of sound energy in different parts of the frequency band.

A similar loudspeaker, but equipped only with a central cone, is known from U.S. Pat. No. 4,628,155. This emits less energy with even poorer quality.

Another design of loudspeaker in the same group of horn loudspeakers is known from U.S. Pat. No. 4,525,604. In this case the sound has to run through very long narrow sound passages, which are also of different lengths, before it can be emitted, which is unfavorable both in terms of energy and acoustically.

The present invention avoids the disadvantages of the known loudspeaker types. The object of the invention is to smooth out the transmission characteristic of the loudspeaker of the type described above, and to enlarge the transmissible frequency band with simple means.

According to a first aspect of the invention, there is provided a loudspeaker wherein the ring surrounding the cone covers the boundary area between the dome and the cone of the diaphragm, and on the side facing the diaphragm the ring's surface consists of two essentially conical surfaces, and wherein the axes of the sound paths between the cone and the neighboring ring and between the two rings are each aligned on a point on the loudspeaker axis, and wherein the sound paths become broader as the distance from the diaphragm increases and wherein the distances from the middle of the underside of the cone and from the middle of the surface of the rings facing the diaphragm to the sound paths are roughly the same.

According to a second aspect of the invention, there is provided a loudspeaker wherein the side of the cone facing the diaphragm covers the dome part of the diaphragm, and wherein the sides of the two rings facing the diaphragm covers the conical part of the diaphragm, and wherein the axes of the sound paths between the cone and the neighboring ring and between the two rings are each aligned on a point on the loudspeaker axis, and wherein the sound paths become broader as the distance from the diaphragm increases and wherein the distances from the middle of the underside of the cone and from the middles of the surfaces of the rings facing the diaphragm and from the outer edge of the diaphragm to the sound paths are roughly the same.

This creates a loudspeaker with excellent transmission properties. It is characterised by a uniform frequency response and high band width.

With this loudspeaker, when a diaphragm of even greater diameter is to be used, it is possible for at least one further similarly formed ring to be disposed between the two rings described above.

In this case, it is advantageous if the body of such a ring is bounded between two or more conical surfaces.

With this loudspeaker the transmission properties can be improved further if those edges of the cone and of the rings which are adjacent to, and face towards, the diaphragm are rounded.

Additionally, it is structurally and acoustically advantageous if the extremities of the cone and of the inner ring or rings which are remote from the diaphragm lie approximately in a common plane.

In addition, it is also advantageous with this loudspeaker if this common plane is disposed adjacent the sound outlet area. Most preferably, the common plane is slightly below (i.e. nearer the diaphragm than) the sound outlet area.

It may be expedient if a flange for fixture of a horn is disposed in the plane of the sound outlet area.

For the acoustic properties of this loudspeaker it is advantageous if the spacing between the diaphragm and the surfaces of the cone and of the rings facing the diaphragm is essentially the same, when the loudspeaker is at rest. Preferably a constant spacing exists between the diaphragm and the surfaces of the cone and the rings which face it.

The features of the invention are described in greater detail below with reference to the accompanying drawings, in which.

Figure 1:
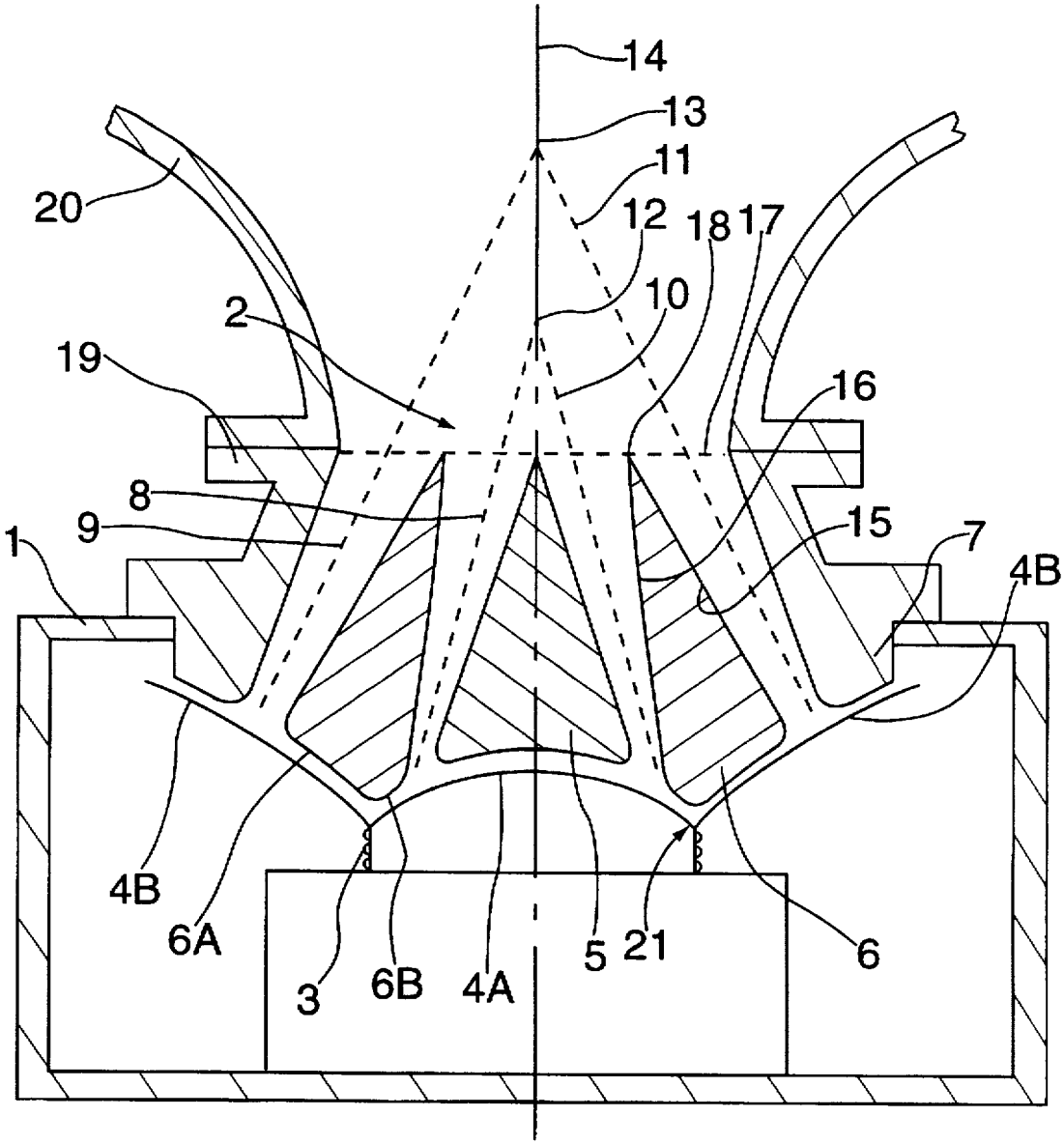
FIG. 1 shows a cross-section through a loudspeaker having a phase-correction device wherein the ring surrounding the cone covers the boundary area between the dome and the cone of the diaphragm, and on the side facing the diaphragm consists of two essentially conical surfaces.

Referring now to FIG. 1, the loudspeaker consists of a housing 1 with a sound outlet opening 2, of a coil 3 which is electromagnetically induced to vibrate and to which the diaphragm 4 is firmly coupled in its central area, and of a phase-correction device. The diaphragm 4 has a central dome-shaped part 4A and a conical part 4B surrounding the latter. The phase-correction device consists of a cone 5 fixed to the housing 1 with its base side facing towards and matching the shape of the diaphragm 4 and of two rings 6,7 coaxially surrounding the cone 5. In the embodiment seen in FIG. 1 the ring 6 surrounding the cone 5 covers the boundary area 21 between the dome 4A and the cone 48 of the diaphragm 4, and on the side facing the diaphragm 4 the ring 6 is formed with two essentially conical surfaces 6A and 6B to match the contours of the inner region of the conical part 4B and the outer part of the dome-shaped part 4A of the diaphragm 4, respectively. Between the cone 5 and the rings 6 and 7 there are sound paths 8,9 which lead from the diaphragm 4 into the sound outlet opening 2. The axes 10, 11 of these sound paths 8,9 between the cone 5 and the neighboring ring 6 and between the two rings 6 and 7 are each aligned on a point 12, 13 on the loudspeaker axis 14. With suitable dimensions, these axes 10, 11 can coincide at one point. The sound paths 8,9 become broader as the distance from the diaphragm 4 increases. Here the distances from the center of the base surface of the cone 5 and from the mid-region of the surface of the ring 6 facing the diaphragm 4, and from the outermost emitting surface of the diaphragm under the ring 7, to the sound paths 8,9 (and these are the maximum sound path lengths from the most remote emission points on the diaphragm to the sound outlet plane in the sound outlet opening 2) are substantially the same.

For the configuration of the ring 6 it is important that it be bounded between two conical surfaces, the external surface 15 and the internal surface 16. These two conical surfaces intersect on a circular line 18 at the extremity of the ring remote from the diaphragm 4.

It is advantageous if those edges of the cone 5 and of the rings 6 and 7 which are adjacent to and facing the diaphragm 4 are rounded.

It is also expedient for the loudspeaker if the tips of the cone 5 and of the inner ring 6 remote from the diaphragm 4 lie roughly in a common plane 17. It is advantageous that the common plane 17 be disposed just under (i.e. slightly nearer the diaphragm 4 than) the sound outlet plane of the sound outlet opening 2.

The housing of the loudspeaker is designed so that a flange 19 for fixing a horn 20 to the housing is formed substantially in the plane of the sound outlet opening 2.

The loudspeaker is built so that the distance between the diaphragm 4 and the surfaces of the cone 5 and of the rings 6,7 facing the diaphragm 4 is essentially the same at every point on the diaphragm when the diaphragm is at rest.

Figure 2:
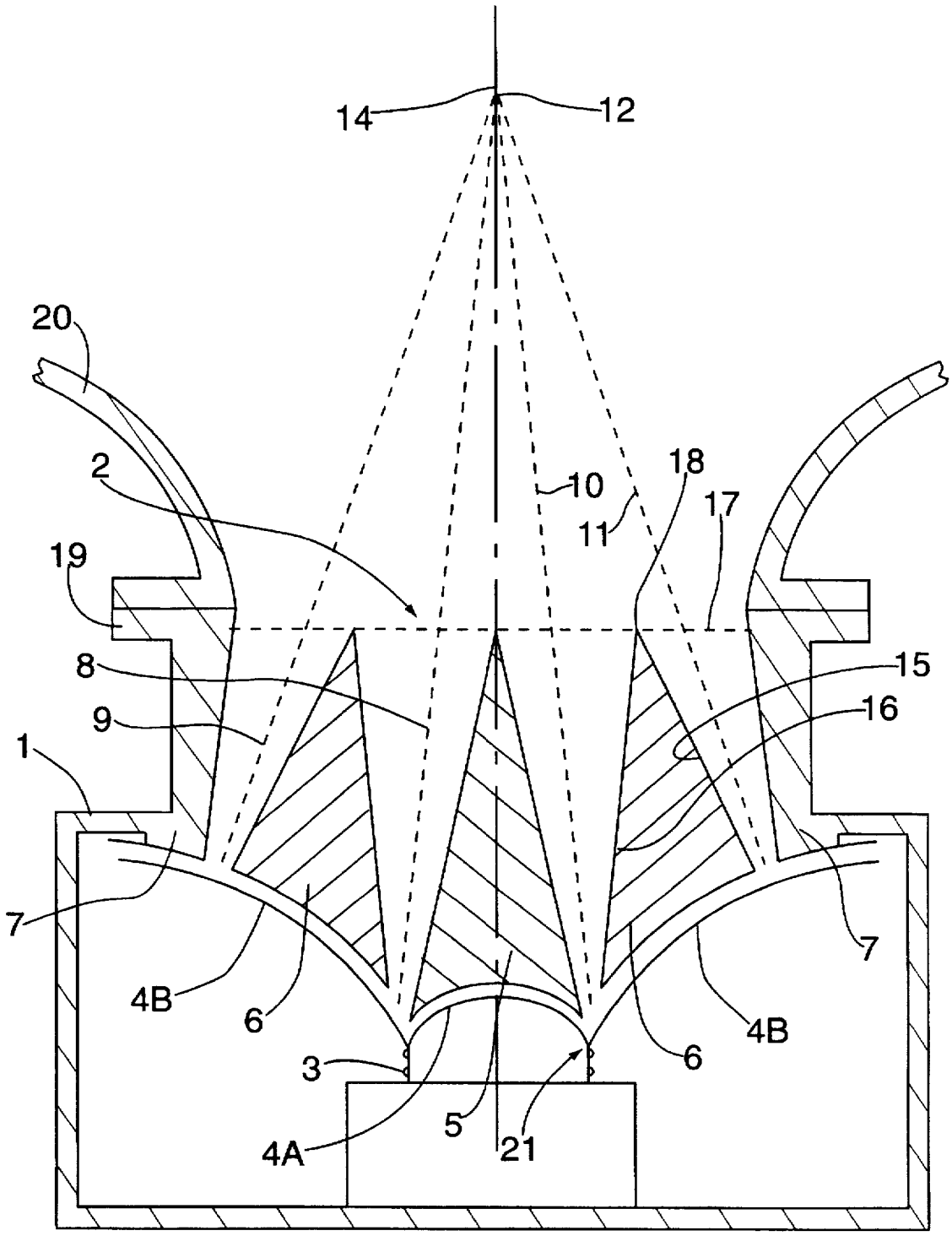
FIG. 2 shows a cross-section through a loudspeaker having a phase-correction device wherein the side of the cone facing the diaphragm covers the dome part of the diaphragm, and the sides of the two rings facing the diaphragm cover the conical part of the diaphragm.

The embodiment seen in FIG. 2 shows a loudspeaker with a phase-correction device in which the side of the cone 5 facing the diaphragm 4 covers the dome part 4A of the diaphragm 4 and the sides of the two rings 6,7 facing the diaphragm 4 cover the conical part 4B of the diaphragm 4. The axes 10, 11 of the sound paths 8,9 between the cone 5 and the neighboring ring 6 and between the two rings 6,7 are each aligned on a point 12, 13 on the loudspeaker axis 14. The sound paths 8,9 become broader as the distance from the diaphragm 4 increases. The distances from the middle of the underside of the cone 5 and from the middle of the surface of the ring 6 neighboring the cone 5 facing the diaphragm 4 and from the outer edge of the diaphragm 4 to the sound paths 8,9 are roughly the same.

The loudspeaker of the present invention can further comprise at least one further ring formed similarly and disposed between the inner ring 6 and the outer ring 7.

We claim:

1. A loudspeaker comprising a housing having a sound outlet opening, a diaphragm mounted within the housing and electromagnetic means to induce the diaphragm to vibrate, wherein the diaphragm is composed of a central dome-shaped part and a conical part surrounding the latter, the loudspeaker further comprising a phase-correction device consisting of a cone fixed in relation to the housing with its base side matching the shape of and facing the diaphragm and inner and outer rings concentrically surrounding the cone, sound paths extending from the diaphragm between the cone and the rings and into the sound outlet area, wherein the inner ring (6) surrounding the cone (5) covers the boundary area (21) between the dome (4A) and the cone (4B) of the diaphragm (4) and on the side facing the diaphragm (4) consists of two essentially conical surfaces (6A, 6B), and wherein the axes (10, 11) of the sound paths (8,9) between the cone (5) and the inner ring (6) and between the inner and outer rings (6,7) are each aligned on a point (12, 13) on the loudspeaker axis (14), and wherein the sound paths (8,9) become broader as the distance from the diaphragm (4) increases and wherein the distances from the middle of the underside of the cone (5) and from the mid-regions of those surfaces of the rings (6,7) facing the diaphragm (4) to the sound paths (8,9) are substantially the same.

2. A loudspeaker according to claim 1, wherein the body of the inner ring (6) is defined between two conical surfaces (15,16).

3. A loudspeaker according to claim 1, wherein the edges of the cone (5) and of the rings (6,7) facing the diaphragm (4) are rounded.

4. A loudspeaker according to claim 1, wherein the tips of the cone (5) and of the inner ring (6) lie roughly in a common plane.

5. A loudspeaker according to claim 4, wherein the common plane is disposed just under the sound outlet area.

6. A loudspeaker according to claim 1, wherein a flange (19) for fixture of a horn (20) is disposed in the plane of the sound outlet area.

7. A loudspeaker according to claim 1, wherein the distance between the diaphragm (4) and the surfaces of the cone (5) and of the rings (6,7) facing the diaphragm (4) is essentially the same in the non-vibrating state.

8. A loudspeaker comprising a housing having a sound outlet opening, a diaphragm mounted within the housing and electromagnetic means to induce the diaphragm to vibrate, wherein the diaphragm is composed of a central dome-shaped part and a conical part surrounding the latter, the loudspeaker further comprising a phase-correction device consisting of a cone fixed in relation to the housing with its base side matching the shape of and facing the diaphragm and inner and outer rings concentrically surrounding the cone, sound paths extending from the diaphragm between the cone and the rings and into the sound outlet area, wherein the side of the cone (5) facing the diaphragm (4) covers the dome part (4A) of the diaphragm (4), and wherein the sides of the inner and outer rings (6,7) facing the diaphragm (4) cover the conical part (4B) of the diaphragm (4), and wherein the axes (10, 11) of the sound paths (8,9) between the cone (5) and the inner ring (6) and between the inner and outer rings (6,7) are each aligned on a point (12, 13) on the loudspeaker axis (14), and wherein the sound paths (8,9) become broader as the distance from the diaphragm (4) increases, and wherein the distances from the middle of the underside of the cone (5) and from the mid-region of the surface of the inner ring (6) facing the diaphragm (4) and from the outer edge of the diaphragm (4) to the sound paths (8,9) are substantially the same.

9. A loudspeaker according to claim 8, wherein the mass of the inner ring (6) is enclosed between two conical surfaces (15, 16).

10. A loudspeaker according to claim 8, wherein the edges of the cone (5) and of the rings (6,7) facing the diaphragm (4) are rounded.

11. A loudspeaker according to claim 8, wherein the tips of the cone (5) and of the inner ring (6) lie roughly in a common plane.

12. A loudspeaker according to claim 11, wherein the common plane is disposed just under the sound outlet area.

13. A loudspeaker according to claim 8, wherein a flange (19) for fixture of a horn (20) is disposed in the plane of the sound outlet area.

14. A loudspeaker according to claim 8, wherein the distance between the diaphragm (4) and the surfaces of the cone (5) and of the rings (6,7) facing the diaphragm (4) is essentially the same in the non-vibrating state.

* * * * *